US005489188A

United States Patent [19]

Meyer et al.

[11] Patent Number: 5,489,188

[45] Date of Patent: Feb. 6, 1996

[54] MEANS FOR CHANGING FREQUENCIES IN ROTARY EQUIPMENT

[75] Inventors: Robert J. Meyer; Izya Korenblit, both of Cincinnati, Ohio

[73] Assignee: ITT Corporation, New York, N.Y.

[21] Appl. No.: 322,259

[22] Filed: Oct. 13, 1994

[51] Int. Cl.[6] ..... F04D 29/66

[52] U.S. Cl. ..... 415/119; 415/213.1; 417/424.1; 248/176.3; 248/676

[58] Field of Search ..... 415/119, 213.1; 417/361, 423.15, 424.1; 248/637, 672, 676, 677, 638, 176, 673, 370; 403/41

[56] References Cited

U.S. PATENT DOCUMENTS

| | | | |
|---|---|---|---|
| 975,526 | 11/1910 | Hood | 417/424.1 |
| 1,767,535 | 6/1930 | Lannert et al. | 417/361 |
| 3,396,665 | 8/1968 | Berman | 415/119 |
| 4,363,217 | 12/1982 | Venuti | 248/638 |
| 5,017,104 | 5/1991 | Baker et al. | 417/424.1 |
| 5,332,373 | 7/1994 | Schendel | 417/424.1 |

FOREIGN PATENT DOCUMENTS

| | | | |
|---|---|---|---|
| 73086 | 4/1985 | Japan | 415/119 |
| 107299 | 5/1987 | Japan | 415/213.1 |

*Primary Examiner*—Edward K. Look
*Assistant Examiner*—James A. Larson
*Attorney, Agent, or Firm*—Menotti J. Lombardi

[57] ABSTRACT

A vertical, centrifugal pump, which is suspended from a pedestal which has the pump-driver/motor set thereupon, is tied to limbs of the pedestal, by an adjustable, threaded rod and bracket. The tying arrangement creates a tension between the pump and the pedestal, resulting in a uniform, common system which has only one natural frequency.

4 Claims, 2 Drawing Sheets

MEANS FOR CHANGING FREQUENCIES IN ROTARY EQUIPMENT

BACKGROUND OF THE INVENTION

This invention pertains to rotary equipment, pedestal-mounted, and in particular to rotary equipment, such as vertical, centrifugal pumps suspended on pedestals which have the equipment or pump driver located, on the pedestal, directly above the equipment or pump.

In the aforedescribed arrangements, where the rotary equipment, or the centrifugal pump is pedestal-suspended, with the driver therefor directly above, vibration problems, under certain conditions, arise. In particular, this problem occurs when the arrangement comprises a variable speed, drive for the equipment or pump.

What has been needed is some means for increasing the stiffness of the driver-supporting pedestal, so as to move the natural frequencies of the rotary equipment and the pedestal out of the operating speed range for the driver and rotary equipment. It would be useful if there were some means for changing the natural frequency mode shape of the pump or other rotary equipment.

This invention sets forth means for increasing the stiffness of the driver pedestal to move the natural frequencies out of the operating speed range. Too, the invention discloses a means which changes the natural frequency mode shape of the subject pump or other rotary equipment.

SUMMARY OF THE INVENTION

It is an object of this invention to disclose, for rotary equipment (a) having a given natural frequency, and (b) mounted to a limbed pedestal which (c) bears the equipment driver, and (d) has a differing natural frequency, means for changing one of said frequencies to match the other of said frequencies, comprising means for coupling said rotary equipment to limbs of said pedestal; wherein said coupling means comprises means for creating a selective mechanical stress between said limbs and said equipment.

Further objects of this invention, as well as the novel features thereof, will become apparent by reference to the following description, taken in conjunction with the accompanying figures.

DETAILED DESCRIPTION OF THE PREFERRED EMBODIMENT

By way of background, prior art centrifugal pumps are commonly fixed in a pedestal, below a drive motor which is supported in elevation by a plurality of limbs. In one arrangement, the limbs are attached to vertical, cast bosses. In another arrangement, the limbs are directly attached to the outside surface of the pump casing. In yet another configuration, the limbs of the pedestal transmit the weight of the driver directly to the supporting foundation without passing though the pump casing. Now, it is known that the natural frequency of a rotary equipment is proportional to the square root of the stiffness to mass ratio:

$$F \sim \left(\frac{K}{M}\right)^{1/2}$$

In order to change the natural frequency, either the mass of the driver, or the stiffness of the driver support must be changed. There is a difference in stiffness between the driver pedestal and the pump itself. Accordingly the natural frequencies of the driver pedestal and the pump can be different. Yet, to minimize vibration problems, both natural frequencies of the pump and the driver pedestal must be outside running speed excitations. The invention addresses the matter in a novel and efficient manner.

Figure 1:
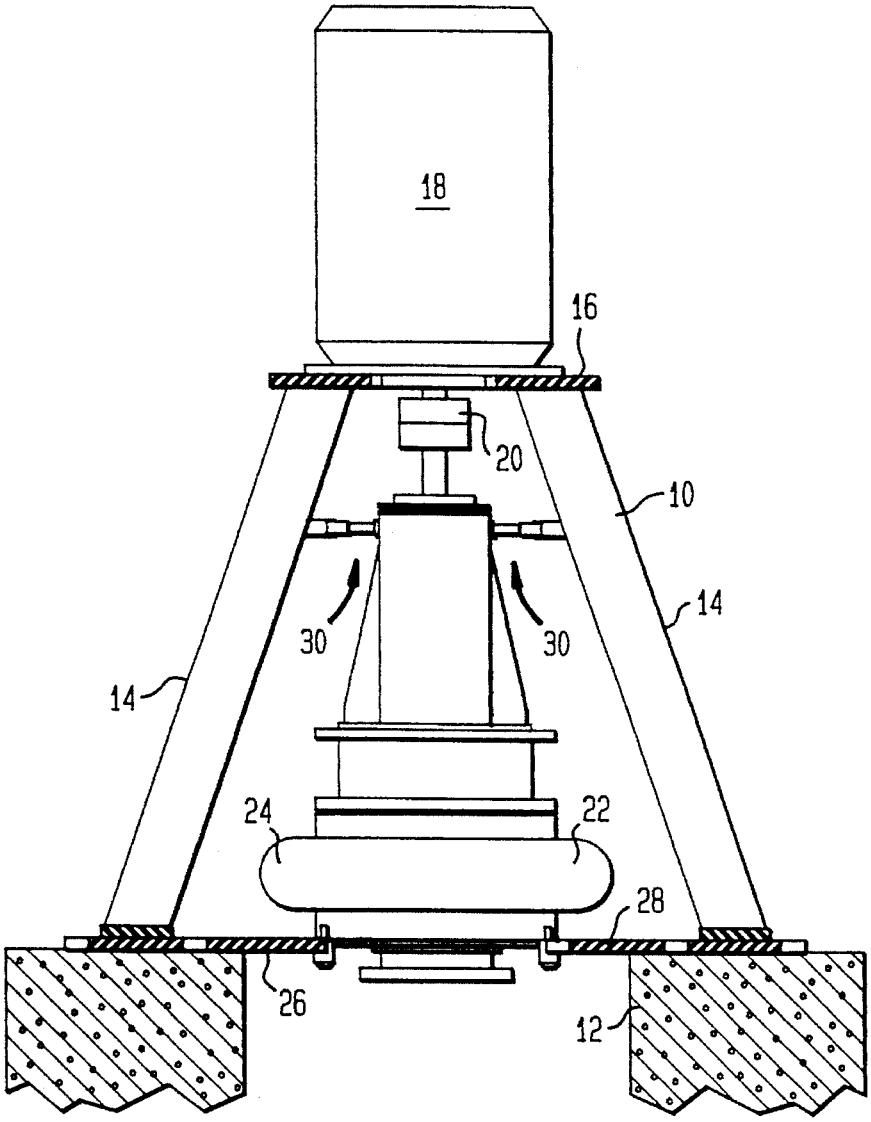
FIG. 1 is a vertical illustration, partly cross-sectioned, of a centrifugal pump, suspended from a pedestal, in which the pump driver is mounted upon the pedestal, directly above the pump, the same incorporating an embodiment of the invention.

In FIG. 1 a pedestal 10 is fixed to a foundation 12 by a plurality of limbs 14, and the limbs 14 have a platform 16 thereupon. A drive motor 18 is supported on the platform 16, and is drive-coupled, by coupling 20, to a vertical, centrifugal pump 22 which is suspended from the pedestal 10. The outer casing 24 of the pump 22 is bolted to foundation plates 26 and 28.

Figure 2:
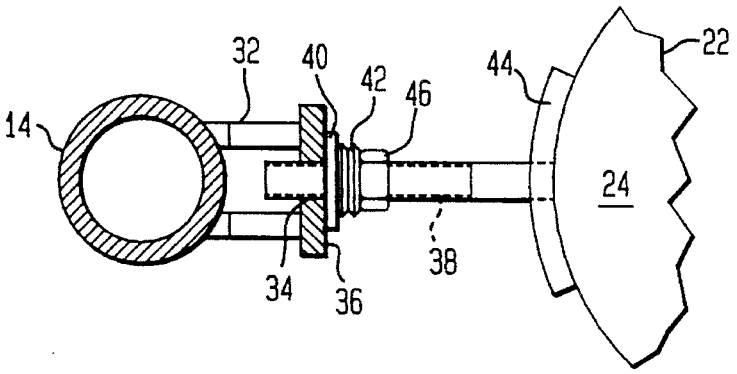
FIG. 2 is a greatly enlarged, plan view of the invention shown in FIG. 1.

An embodiment 30 of the invention is interconnected to each of the limbs 14 and the upper portion of the pump 22, as shown in FIG. 1. The invention is seen in greater detail, in FIG. 2.

Limb 14 has a bracket 32 fixed thereto, as by welding or any other suitable means. The bracket 32 has an aperture 34 formed therein, the same being formed through an end bearing surface 36 of the bracket 32. A threaded rod 38 has an end extending through aperture 34, and has a flat thrust washer 40 and a plurality of spring washers 42 mounted thereon. In addition, the rod is fixed, at the opposite end thereof, in bracing 44 which bears against the casing 24 of the pump 22. A nut 46 is threadedly engaged with the rod 38 and contacts the spring washers 42. By torquing the nut 46 up against the spring washers 42, a tension is created between the limb 14 and the pump 22. With embodiments 30 on each of the limbs 14, the nuts 46 thereof can be adjusted to create equal tension between each limb 14 and the pump 22. In being so tensioned, the pump 22 and the driver pedestal 10 constitute a uniform, common system which has only one natural frequency.

Figure 3:
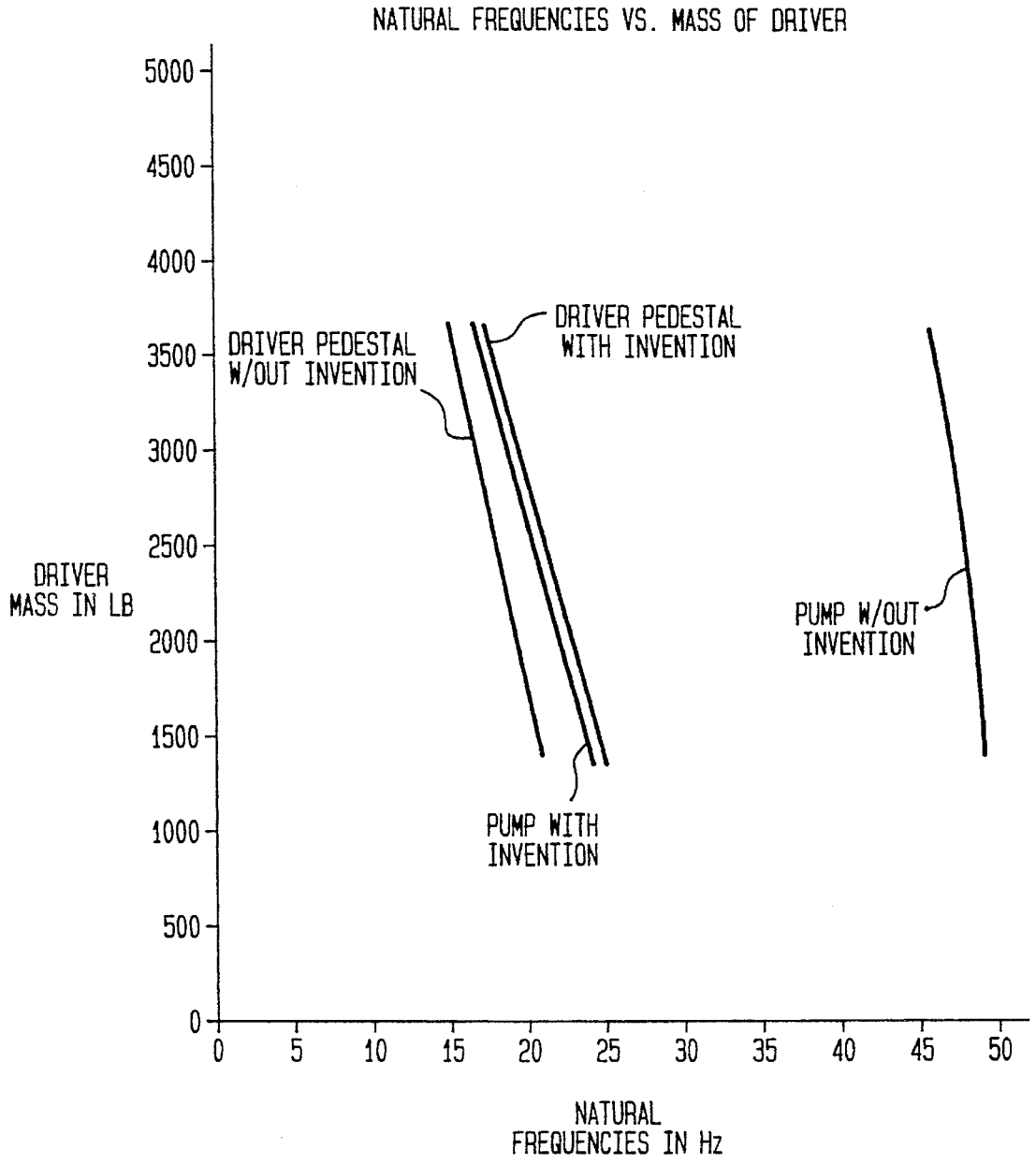
FIG. 3 is a graph which sets out, thereon, natural frequencies vs. mass of the driver, with the driver pedestal and the pump without the invention, and with the invention.

FIG. 3 shows the natural frequencies vs. driver or motor mass with the invention embodiment 30 and without the invention embodiment 30. As set out in FIG. 3, the natural frequencies with the invention embodiment 30 are significantly higher than without the invention embodiment. In fact, the natural frequency of the pump 22 itself changes, and becomes equal to the natural frequency of the driver pedestal 10. Consequently, through use of this invention 30, only one frequency of the pump 22/driver pedestal 10 must be outside of the operating speed range. The invention embodiment 30 ensures that the natural frequency of the driver pedestal 10 and the natural frequency of the pump 22 will be the same, and that one frequency will be higher than the driver pedestal 10 frequency by itself without the invention 30.

While we have described our invention in connection with a specific embodiment thereof, it is to be clearly understood that this is done only by way of example and not as a limitation to the scope of the invention, as set forth in the objects thereof and in the appended claims. For instance, the bracket 32 could have a slot, for receiving the threaded rod 38 therein, in lieu of an aperture 34. Also, the pump casing 24 could have the bracket 32 fixed thereto and the bracing 44 could be forceably engaged with the limb 14. Any expedient means which creates a selective, tensioned stress between the limb 14 and the pump 22, would be within the teaching of this disclosure, and be embraced by the claims.

We claim:

1. For rotary equipment (a) having a given natural frequency, and (b) being mounted to a limbed pedestal, said pedestal bearing an equipment driver, and having a differing natural frequency, means for changing one of said frequencies to match the other of said frequencies, comprising:

means for coupling said rotary equipment to limbs of said pedestal; wherein said coupling means comprises means for creating a selective mechanical stress between said limbs and said equipment;

said stress creating means comprises a bracket for attachment to one of said limbs;

said bracket has a bearing surface formed thereon; and means, for interpositioning between said equipment and said bearing surface, for biasingly constraining said bearing surface away from said equipment.

2. Means for changing frequencies, according to claim 1, wherein:

said bracket has an aperture formed therein;

said constraining means comprises a threaded rod;

one end of said rod is in penetration of said aperture; and means threadedly engaged with said rod for biasingly applying a force to said bearing surface.

3. Means for changing frequencies, according to claim 2, further including:

spring washers slidably mounted on said rod; and said force applying means comprises a nut for compressing said spring washers against a thrust washer mounted on said rod and against said bearing surface.

4. Means for changing frequencies, according to claim 2, wherein:

said rod has the opposite end thereof fixed in bracing; and said bracing is set against said equipment.

* * * * *